US010872573B2

(12) United States Patent
Li

(10) Patent No.: US 10,872,573 B2
(45) Date of Patent: Dec. 22, 2020

(54) PIXEL DRIVE CIRCUIT, DISPLAY DEVICE AND DRIVING METHOD

(71) Applicant: WUHAN CHINA STAR OPTOELECTRONICS SEMICONDUCTOR DISPLAY TECHNOLOGY CO., LTD., Hubei (CN)

(72) Inventor: Jun Li, Hubei (CN)

(73) Assignee: WUHAN CHINA STAR OPTOELECTRONICS SEMICONDUCTOR DISPLAY TECHNOLOGY CO., LTD., Hubei (CN)

( * ) Notice: Subject to any disclaimer, the term of this patent is extended or adjusted under 35 U.S.C. 154(b) by 0 days.

(21) Appl. No.: 16/472,892

(22) PCT Filed: Jan. 4, 2019

(86) PCT No.: PCT/CN2019/070507

§ 371 (c)(1),
(2) Date: Jun. 23, 2019

(87) PCT Pub. No.: WO2020/118814

PCT Pub. Date: Jun. 18, 2020

(65) Prior Publication Data

US 2020/0265786 A1 Aug. 20, 2020

(30) Foreign Application Priority Data

Dec. 11, 2018 (CN) ..... 2018 1 1507427

(51) Int. Cl.
*G09G 3/3291* (2016.01)
*G09G 3/36* (2006.01)

(52) U.S. Cl.
CPC ..... *G09G 3/3291* (2013.01); *G09G 3/3688* (2013.01); *G09G 2310/0286* (2013.01); *G09G 2320/0233* (2013.01)

(58) Field of Classification Search
CPC ..... G09G 3/3291; G09G 3/3688; G09G 2310/0286; G09G 2320/0233; G09G 3/3233; G09G 3/3266; G09G 3/3258; G09G 3/3696; G09G 2300/0861; G09G 2300/0819; G09G 2310/0262; G09G 2310/0251
See application file for complete search history.

(56) References Cited

U.S. PATENT DOCUMENTS 5,912,712 A * 6/1999 Doherty ..... G09G 3/2018 348/471
2009/0108768 A1* 4/2009 Yang ..... H05B 45/00 315/291
2018/0091151 A1* 3/2018 Zheng ..... G11C 19/28
2018/0308427 A1* 10/2018 Zhang ..... H01L 27/3265

* cited by examiner

*Primary Examiner* — Brent D Castiaux
(74) *Attorney, Agent, or Firm* — Muncy, Geissler, Olds and Lowe, P.C.

(57) ABSTRACT

A pixel drive circuit, a display device and a driving method. The pixel drive circuit, the display device and the driving method can effectively compensate for the problem of poor panel uniformity caused by the resistance drop and improve the uniformity of the panel.

12 Claims, 6 Drawing Sheets

PIXEL DRIVE CIRCUIT, DISPLAY DEVICE AND DRIVING METHOD

BACKGROUND

1. Field of the Invention

The present disclosure relates to the field of liquid crystal display, more particularly, to a pixel drive circuit, a display device and a driving method.

2. Description of the Related Art

Organic light emitting diode (OLED) display panel having many advantages, such as self-luminousness, low driving voltage, high luminous efficiency, short response time, high definition and contrast ratio, nearly 180 degree viewing angle, wide operating temperature range, flexible display, large-area full-color display, and the like, is recognized by the industry as the most promising display device.

Based on the driving method, an OLED can be divided into a passive matrix (PM) OLED and an active matrix (AM) OLED. Namely, two categories including direct addressing and thin film transistor (TFT) matrix addressing.

An AMOLED display panel has a plurality of pixels arranged in an array. Each of the pixels is driven by an OLED pixel drive circuit.

As shown in FIG. 1, a pixel drive circuit for an AMOLED in the related art is a 2T1C structure, and comprises a switch thin film transistor (that is, a switch TFT) T1, a driver thin film transistor (that is, a driver TFT) T2, and a storage capacitor Cst. Both the switch TFT and the driver TFT are n-type TFTs. A driving current of an OLED is controlled by the driver TFT. The known formula for calculating the driving current is:

$$I_{OLED}=k(V_{gs}-V_{th})^2$$

where $I_{OLED}$ represents the driving current, k is the current amplification factor of the driver TFT and is determined by an electrical characteristic of the driver TFT itself, Vgs represents a voltage difference between a gate and a source of the driver TFT, Vth represents the threshold voltage of the driver TFT. It can be seen that the driving current $I_{OLED}$ is related to the threshold voltage of the driver TFT.

Since the threshold voltage Vth of the driver TFT tends to drift, the driving current of the OLED fluctuates. It is easy to cause uneven brightness of the AMOLED display panel. As a result, there are situations, such as poor display and affected image quality, etc.

Because the pixel drive circuit for an AMOLED in the related art that is the 2T1C structure does not have the function of compensating for the threshold voltage Vth of the driver TFT, relevant researchers have proposed various pixel drive circuits capable of compensating for the threshold voltage Vth of the driver TFT. A description is provided with reference to FIG. 2. FIG. 2 is a pixel drive circuit for an AMOLED in the related art that is a 7T1C structure and has a function of compensating for a threshold voltage of a driver TFT. The circuit comprises seven transistors and one capacitor, that is, a first P-type TFT (which is a driver TFT) T1, a second P-type TFT T2, a third P-type TFT T3, a fourth P-type TFT T4, a fifth P-type TFT T5, a sixth P-type TFT T6, and a seventh P-type TFT T7. A description is provided with reference to a timing diagram shown in FIG. 3. A detailed working process of the pixel drive circuit of the AMOLED in the related art that is the 7T1C structure is as follows.

The first state: reset stage of a gate of the driver TFT. At this time, a previous scan signal SCAN[n−1] is at a low level. A scan signal SCAN[n] and a light-emitting control signal EM are at a high level. A potential of the gate of the first P-type TFT T1 passes through the fourth P-type TFT T4 is reset to a lower potential VI.

The second stage: data signal writing and threshold voltage compensation stage, and at the same time a reset of an organic light emitting diode is completed. At this time, the scan signal SCAN[n] is at the low level, and the previous scan signal SCAN[n−1] and the light-emitting control signal EM are both at the high level. At this time, the gate and a drain of the first P-type TFT T1 are short-circuited to form a diode connection. A data signal Data is written into a source of the first P-type TFT through the turned-on third P-type TFT T3, and the potential of the gate of the first P-type TFT T1 is charged to Vdata-Vth by utilizing the diode connect, where Vdata represents a voltage of the data signal Data, and Vth represents a threshold voltage of the driver TFT. In addition, the seventh P-type TFT T7 is turned on. An anode of the organic light emitting diode OLED is connected to VI, and the anode of the organic light emitting diode OLED is reset to the VI potential (reset voltage).

The third stage: light-emitting stage. At this time, only the light-emitting control signal EM is at the low level. The scan signal SCAN[n] and the previous scan signal SCAN[n−1] are at the high level. The fifth P-type TFT T5 and the sixth P-type TFT T6 are turned on, and a driving current flows into the organic light emitting diode OLED from the first P-type TFT T1 to drive the organic light emitting diode OLED to emit light. The calculation formula for the driving current is:

$$I_{OLED}=k(VDD-(V\text{data}-|V\text{th}|)-|V\text{th}|)^2=k(VDD-V\text{data})^2$$

Where $I_{OLED}$ represents the driving current, K represents a current amplification factor of the first P-type TFT T1, that is, the driver TFT, and VDD represents a positive power supply voltage. It can be seen that the driving current $I_{OLED}$ is not related to the threshold voltage Vth of the first P-type TFT T1. In this manner, the problem of poor display of the AMOLED picture that is caused by drift of the threshold voltage of the first P-type TFT, that is, the driver TFT, is eliminated. At the same time, resetting the organic light emitting diode OLED can improve the contrast of the AMOLED.

Technical Problem

However, the above pixel drive circuit for the AMOLED that is the 7T1C structure has problems. When the organic light emitting diode OLED emits light, the driving current is related to the positive power supply voltage VDD, and the positive power supply voltage VDD is required to supply a current. In consideration of that a trace of the positive power supply voltage VDD has an impedance, the actual VDD voltage obtained by a pixel unit is smaller than the VDD voltage supplied by the power supply under the effect of resistance drop (IR drop), that is, $VDD_{pixel}=VDD-I_{oled}*R_{VDD}$. As compared with a lower end of the AMOLED panel, an upper end of the AMOLED panel is farther away from the positive power supply voltage VDD, and a resistance is larger. Therefore, the positive power supply voltage VDD at this position decreases more seriously, thus resulting in the upper end of the panel being dark and the lower end being bright. As a result, the panel uniformity is seriously affected.

Therefore, it is an important subject of the display technology to effectively resolve the problem that the upper end of the panel is dark and the lower end of the panel is bright and improve the uniformity of the panel.

SUMMARY

One objective of the present disclosure is to provide a pixel drive circuit, a display device and a driving method, which can effectively compensate for the problem of poor panel uniformity caused by the resistance drop and improve the uniformity of the panel.

The present disclosure provides a pixel drive circuit corresponding to a GOA unit. The pixel drive circuit comprises: a shift register circuit and a pixel compensation circuit; the shift register circuit comprising a signal input terminal, a signal output terminal and at least one clock signal input terminal, the signal input terminal being configured to receive an input signal, the clock signal input terminal being configured to receive a clock signal, the shift register circuit being configured to process the input signal based on the clock signal and generate a first control signal and transmit the first control signal to the signal output terminal, wherein the first control signal comprises a voltage compensation signal for compensating for a threshold voltage of the pixel compensation circuit and a time adjustment signal for adjusting a light-emitting time of the pixel compensation circuit; the shift register circuit further comprising a voltage adjustment module, the voltage adjustment module being connected to the signal output terminal of the shift register circuit, the voltage adjustment module being configured to perform pulse with modulation on the time adjustment signal in the first control signal generated by the shift register circuit within a predetermined time period, so that the light-emitting time of the pixel compensation circuit varies with the pulse width modulation, wherein the predetermined time period is a time period between an end of writing all data signals of one frame and a start of a control signal of a next frame; the signal output terminal of the shift register circuit being connected to a light-emitting control terminal of the pixel compensation circuit, the light-emitting control terminal changing a turn-on time of a light-emitting module of the pixel compensation circuit correspondingly based on a pulse width variation of the time adjustment signal in the received first control signal so as to adjust a light-emitting time of a light-emitting component in the corresponding GOA unit.

According to an embodiment of the present disclosure, the voltage adjustment module comprises a voltage adjustment control terminal, a voltage adjustment input terminal, and a voltage adjustment output terminal, the voltage adjustment input terminal is configured to receive a threshold value voltage signal, the voltage adjustment output terminal is connected to the signal output terminal of the shift register circuit, the voltage adjustment control terminal is configured to receive an enable signal within the predetermined time period, and perform pulse width modulation on the time adjustment signal through the threshold value voltage signal under a control of the enable signal According to an embodiment of the present disclosure, the pixel compensation circuit comprises a first reset module, a second reset module, a compensation module, a write module, and a light-emitting module; a control terminal of the first reset module receiving a second control signal, another two terminals of the first reset module being respectively connected to a first reset voltage terminal and the compensation module, the first reset voltage terminal having a first reset voltage, and the first reset module transmitting the first reset voltage to the compensation module under a control of the second control signal; a control terminal of the second reset terminal receiving a third control signal, another two terminals of the second reset module being respectively connected to a second reset voltage terminal and the light-emitting module, the second reset voltage terminal having a second reset voltage, and the second reset module transmitting the second reset voltage to the light-emitting module under a control of the third control signal; a control terminal of the write module receiving a fourth control signal, an input terminal of the write module being connected to a data signal terminal and receiving a data signal from the data signal terminal, an output terminal of the write module being connected to the compensation module, the write module transmitting the data signal to the compensation module under a control of the fourth control signal; the compensation module receiving a fifth control signal, and being connected to the first reset module, the write module and the light-emitting module, the compensation module performing threshold voltage compensation under a control of the fifth control signal; one terminal of the light-emitting module being connected to a second voltage terminal and receiving a second voltage from the second voltage terminal, another two terminals of the light-emitting module being both connected to the compensation module, the light-emitting control terminal of the light-emitting module and the signal output terminal of the shift register circuit being connected, the light-emitting module changing the turn-on time correspondingly based on the pulse width variation of the time adjustment signal in the received first control signal so as to adjust the light-emitting time of the light-emitting component in the corresponding GOA unit.

According to an embodiment of the present disclosure, the first reset module comprises a fourth TFT, a gate of the fourth TFT receives the second control signal, a source receives the first reset voltage, a drain is connected to the compensation module, the fourth TFT transmits the first reset voltage to the compensation module under the control of the second control signal.

According to an embodiment of the present disclosure, the second reset module comprises a seventh TFT, a gate of the seventh TFT receives the third control signal, a source receives the second reset voltage, a drain is connected to the light-emitting module, the seventh TFT transmits the second reset voltage to the light-emitting module under the control of the third control signal.

According to an embodiment of the present disclosure, the write module comprises a third TFT, a gate of the third TFT receives the fourth control signal, a source is connected to the data signal terminal, a drain is connected to the compensation module, the third TFT transmits the data signal of the data signal terminal to the compensation module under the control of the fourth control signal.

According to an embodiment of the present disclosure, the compensation module comprises a first TFT, a second TFT, and a storage capacitor, the gate of the first TFT is connected to the drain of the fourth TFT of the first reset module, one terminal of the storage capacitor and a drain of the second TFT, a source is connected to a source of a sixth TFT of the light-emitting module and the drain of the third TFT of the write module, a drain is connected to a drain of a fifth TFT of the light-emitting module and a source of the second TFT, a gate of the second TFT receives the fifth control signal, another terminal of the storage capacitor is connected to a first voltage terminal.

According to an embodiment of the present disclosure, a gate of the sixth TFT is connected to the light-emitting control terminal, a drain receives a first voltage from the first voltage terminal, the source is connected to the source of the first TFT of the compensation module, a gate of the fifth TFT is connected to the light-emitting control terminal, the drain is connected to the drain of the first TFT of the compensation module, a source is connected to an anode of the light-emitting component and the drain of the seventh TFT of the second reset module, a cathode of the light-emitting component is connected to the second voltage terminal.

According to an embodiment of the present disclosure, the first reset voltage, the second reset voltage, and the second voltage are low voltages, the first voltage is a high voltage.

According to an embodiment of the present disclosure, the first TFT, second TFT, third TFT, fourth TFT, fifth TFT, sixth TFT, and seventh TFT are P-type TFTs.

According to a second aspect of the present disclosure, a display device comprises a plurality of gate on array (GOA) units. Each of the GOA units comprises a light-emitting component and a pixel drive circuit and each of the GOA units connects to a power supply trace that supplies power supply voltage.

According to a third aspect of the present disclosure, a method of driving the pixel driving circuit comprises: (a) at a reset stage, setting a second control signal to a low level so that the fourth TFT is turned on, wherein the fourth TFT transmits a first reset voltage to the gate of the first TFT to allow a gate voltage of the first TFT to be reset to the first reset voltage; (b) at a data writing stage, setting a fourth control signal to the low level to allow the third TFT to be turned on, wherein the third TFT transmits a data voltage received by a data voltage terminal to the source of the first TFT of the compensation module; (c) at a threshold voltage compensation stage, setting a fifth control signal to the low level and a first control signal to the high level, so that the first TFT is turned on, wherein the data voltage charges the gate of the first TFT until a gate potential of the first TFT is charged to a difference between the data voltage and a threshold voltage of first TFT; and (d) at a light-emitting stage, setting the first control signal at the light-emitting control terminal to the low level, so that the sixth TFT and the fifth TFT are turned on, and the light-emitting component emits light. The step (d) further comprises: performing pulse width modulation on a time adjustment signal in the first control signal generated by a shift register circuit through a voltage adjustment module within a predetermined time period, so that a light-emitting time of the pixel compensation circuit varies with the pulse width modulation. The predetermined time period is a time period between an end of writing all data signals of one frame and a start of a control signal of a next frame.

According to an embodiment of the present disclosure, the step (c) comprises: setting a third control signal set to the low level so that the seventh TFT is turned on to transmit a second reset voltage to the light-emitting module.

The beneficial effects of the present disclosure are as follows. The pixel drive circuit, the display device and the driving method according to the present disclosure can effectively compensate for the problem of poor panel uniformity caused by the resistance drop and improve the uniformity of the panel.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

For the purpose of description rather than limitation, the following provides such specific details as a specific system structure, interface, and technology for a thorough understanding of the application. However, it is understandable by persons skilled in the art that the application can also be implemented in other embodiments not providing such specific details. In other cases, details of a well-known apparatus, circuit and method are omitted to avoid hindering the description of the application by unnecessary details.

The term "first", "second" are for illustrative purposes only and are not to be construed as indicating or imposing a relative importance or implicitly indicating the number of technical features indicated. Thus, a feature that limited by "first", "second" may expressly or implicitly include at least one of the features. In the description of the present disclosure, the meaning of "plural" is two or more, unless otherwise specifically defined.

In the description of this specification, the description of the terms "one embodiment", "some embodiments", "examples", "specific examples", or "some examples", and the like, means to refer to the specific feature, structure, material or characteristic described in connection with the embodiments or examples being included in at least one embodiment or example of the present disclosure. In the present specification, the term of the above schematic representation is not necessary for the same embodiment or example. Furthermore, the specific feature, structure, material, or characteristic described may be in combination in a suitable manner in any one or more of the embodiments or examples. In addition, it will be apparent to those skilled in the art that different embodiments or examples described in this specification, as well as features of different embodiments or examples, may be combined without contradictory circumstances.

In the several embodiments provided by the application, it should be understood that the revealed system, device and method may be implemented in other ways. For example, the abovementioned embodiments of the device are merely schematic. For example, the division of the circuits is merely a division based on logical functions; it may be different when they are put into practice. For example, a plurality of circuits or components may be combined or integrated into another system, or some features may be ignored or not be performed. And another point is that the displayed or discussed coupling, direct coupling or communication can be done through some interfaces, devices, or indirect coupling or communication between circuits; they may be electrical, mechanical, or in other forms.

A pixel drive circuit, a display device and a driving method are provided according to embodiments of the present disclosure. A detailed description is provided as follows.

Figure 1:
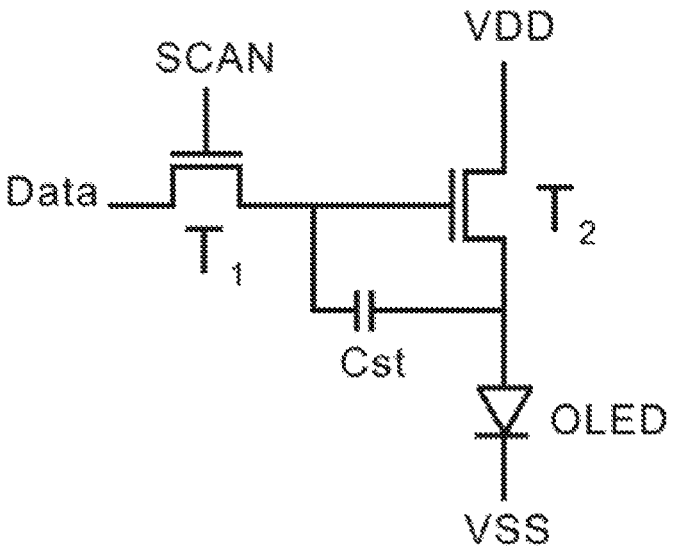
FIG. 1 is a schematic diagram of a pixel drive circuit that is a 2T1C structure in the related art.
Figure 2:
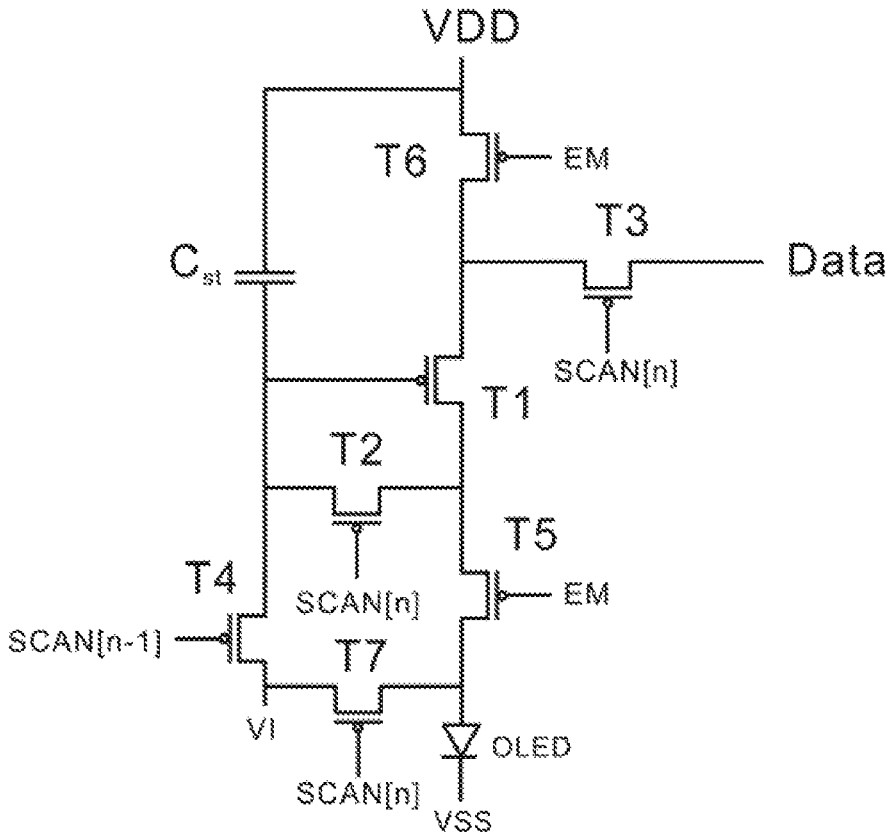
FIG. 2 is a schematic diagram of a pixel drive circuit that is a 7T1C structure in the related art.
Figure 3:
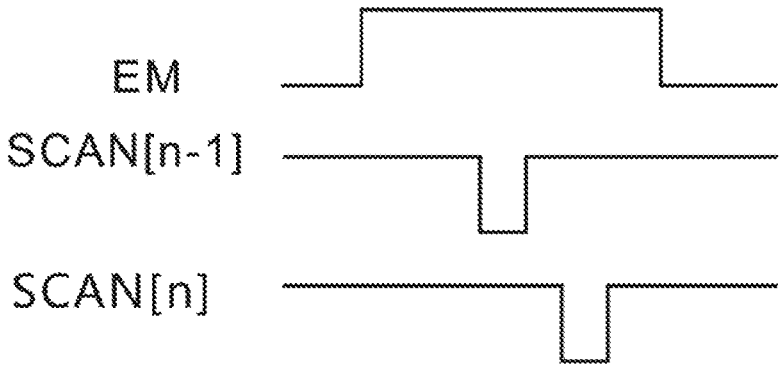
FIG. 3 is a timing diagram of a pixel drive circuit that is a 7T1C structure in the related art.
Figure 4:
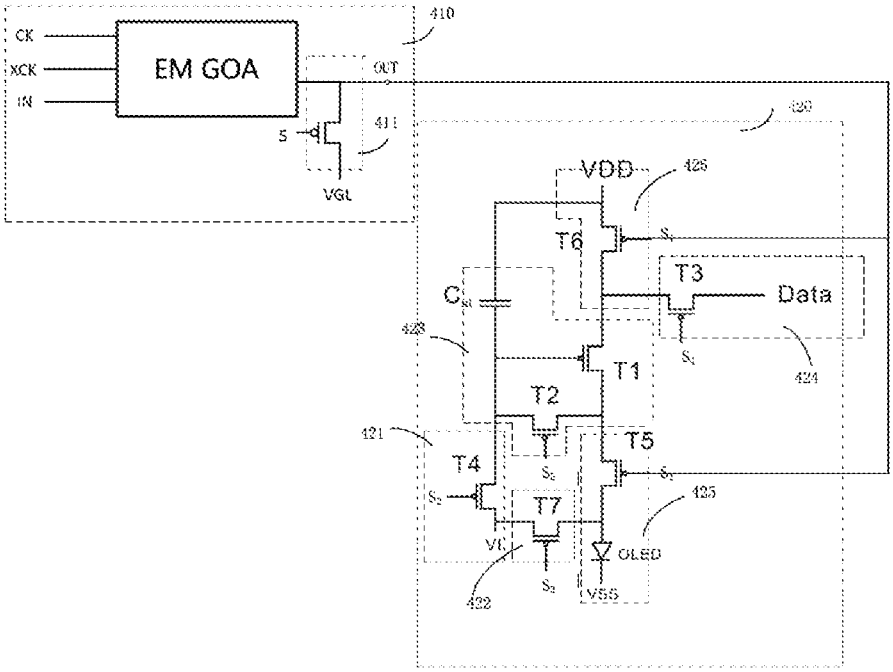
FIG. 4 is a schematic diagram of a pixel drive circuit according to one embodiment of the present disclosure.
Figure 5:
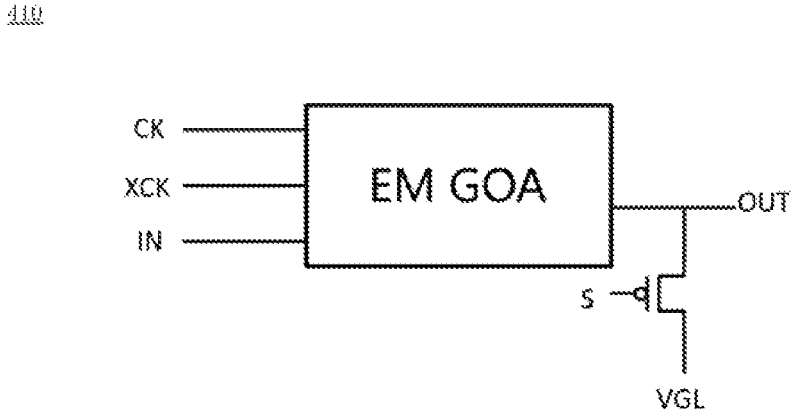
FIG. 5 is a schematic diagram of a shift register circuit according to some embodiments of the present disclosure.
Figure 6:
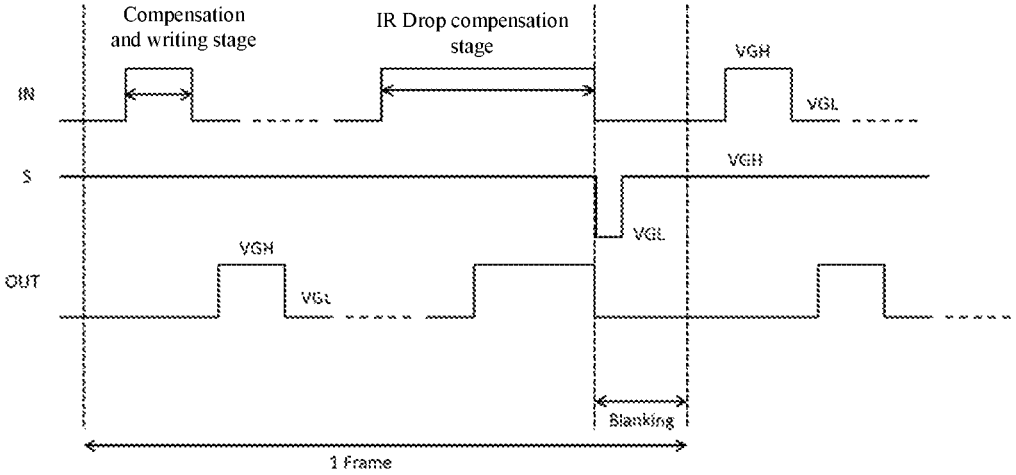
FIG. 6 is a timing diagram of a shift register circuit according to some embodiments of the present disclosure.
Figure 7:
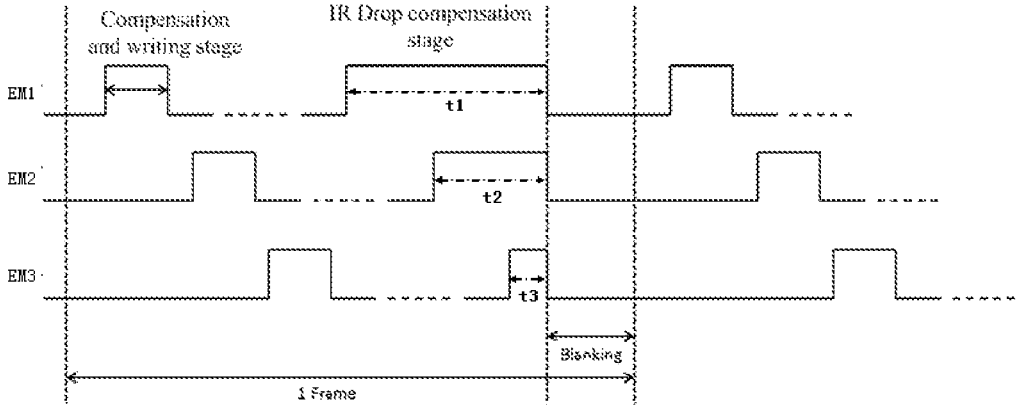
FIG. 7 is a timing diagram of a pixel drive circuit according to some embodiments of the present disclosure.

A description is provided with reference to FIG. 4 to FIG. 7. FIG. 4 is a schematic diagram of a pixel drive circuit according to one embodiment of the present disclosure. FIG. 5 is a schematic diagram of a shift register circuit according to some embodiments of the present disclosure. FIG. 6 is a timing diagram of a shift register circuit according to some embodiments of the present disclosure. FIG. 7 is a timing diagram of a pixel drive circuit according to some embodiments of the present disclosure.

The present disclosure provides a pixel drive circuit corresponding to a gate on array (GOA) unit. The pixel drive circuit comprises a shift register circuit 410 and a pixel compensation circuit 420.

The shift register circuit 410 comprises a signal input terminal IN, a signal output terminal OUT and at least one clock signal input terminal (CK and XCK). The clock signal input terminal is configured to receive a clock signal. In the present embodiment, a number of clock signal input terminals is 2, and the clock signal input terminals respectively receive a CK signal and an XCK signal. These two signals are clock signals having a same frequency but opposite phases. The signal input terminal IN is configured to receive an input signal, which is an initial trigger signal provided by a host. The input signal comprises a voltage compensation signal for compensating for a threshold voltage of the pixel compensation circuit 420 and a time adjustment signal for adjusting a light-emitting time of the pixel compensation circuit 420. The shift register circuit 410 is configured to process the input signal based on the clock signals, and generate a first control signal $S_1$ and transmit the first control signal $S_1$ to the output terminal OUT. The first control signal $S_1$ comprises a voltage compensation signal for compensating for the threshold voltage of the pixel compensation circuit 420 and a time adjustment signal for adjusting the light-emitting time of the pixel compensation circuit 420. Hence, the first control signal $S_1$ may serve as a light-emitting control signal EM of a light-emitting module of the pixel compensation circuit 420. Since the shift register circuit 410 has a shift function, through the shift processing of the shift register circuit 410, a second light-emitting control signal EM2, when compared with the first light-emitting control signal EM1, can be made as follows. The second light-emitting control signal EM2 lags behind the first light-emitting control signal EM1 and has a same waveform as the first light-emitting control signal EM1. Similarly, a third light-emitting control signal EM3, when compared with the second light-emitting control signal EM2, can be made as follows. The third light-emitting control signal EM3 lags behind the second light-emitting control signal EM2 and has a same waveform as the second light-emitting control signal EM2. A fourth light-emitting control signal EM4, when compared with the third light-emitting control signal EM3, can be made as follows. The fourth light-emitting control signal EM4 lags behind the third light-emitting control signal EM3 and has a same waveform as the third light-emitting control signal EM3, and so forth.

The shift register circuit 410 further comprises a voltage adjustment module 411. The voltage adjustment module 411 is connected to the signal output terminal OUT of the shift register circuit 410. The voltage adjustment module 411 is configured to perform pulse with modulation on a time adjustment signal in the first control signal $S_1$ generated by the shift register circuit 410 within a predetermined time period, so that the light-emitting time of the pixel compensation circuit 420 varies with the pulse width modulation. The predetermined time period is a time period between an end of writing all data signals of one frame and a start of a control signal of a next frame, and the predetermined time period is also generally called a blanking area, as shown in FIG. 6. The predetermined time period is comprised in a normal frame.

In the present embodiment, the voltage adjustment module 411 comprises: a voltage adjustment control terminal, a voltage adjustment input terminal and a voltage adjustment output terminal. The voltage adjustment input terminal is configured to receive a threshold value voltage signal. In the present embodiment, the threshold value voltage signal is a low voltage VGL. The voltage adjustment output terminal is connected to the signal output terminal OUT of the shift register circuit 410. The voltage adjustment control terminal is configured to receive an enable signal S within the predetermined time period, and perform pulse width modulation on the time adjustment signal through the threshold value voltage signal VGL under a control of the enable signal S.

Figure 8:
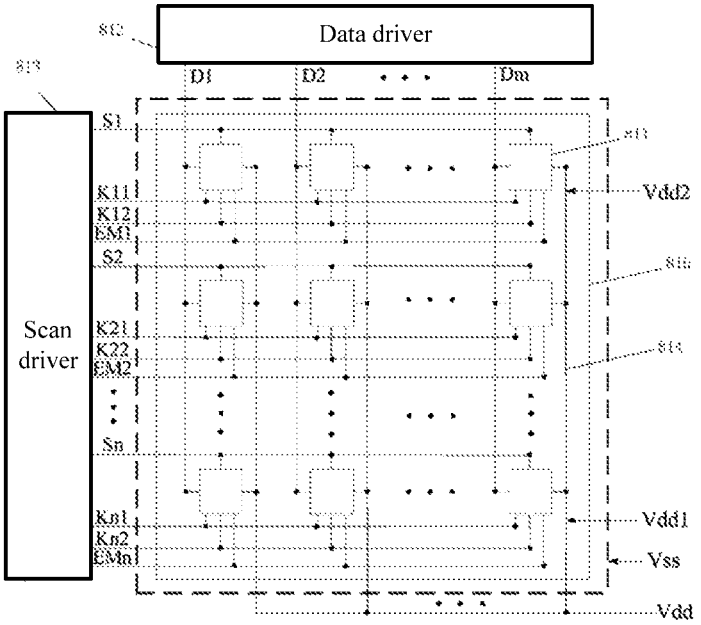
FIG. 8 is a schematic diagram of a display device according to one embodiment of the present disclosure.

As shown in FIG. 6, the time adjustment signal is a pulse signal, and its right edge is aligned with a left edge of the blanking area. A low level of the enable signal S is in the blanking area, and its falling edge is aligned with the left edge of the blanking area. In the blanking area, the enable signal S is in an enabled state to forcibly set the time adjustment signal to the low level, and thus a high-level pulse of the inserted time adjustment signal is gradually narrowed. In other words, a duration of a time adjustment signal for controlling a first row of GOA units is set to t1, a duration of a time adjustment signal for controlling a second row of GOA units is set to t2, a duration of a time adjustment signal for controlling a third row of GOA units is set to t3, and so forth, a duration of a time adjustment signal for controlling an nth row of GOA units is set to tn. Through the enabling effect of the enable signal, the durations gradually decrease when comparing t2 with t1, t3 with t2, t4 with t3, until tn with tn−1, as shown in FIG. 7. As described later, the GOA unit (such as the one indicated by the reference number 811 in FIG. 8) does not emit light when the light-emitting control signal is at the high level, and the GOA unit (such as the one indicated by the reference number 811 in FIG. 8) emits light when the light-emitting control signal is at the low level. Hence, the longer the time adjustment signal is (indicated by the pulse width in FIG. 6), that is, the longer the light-emitting control signal EM is at the high level, the shorter the light-emitting time is, and the darker the average brightness is (considering that the human eye functions like an integral system, the shorter the light-emitting time in a frame time is, the smaller the integral value). Similarly, the shorter the time adjustment signal is, that is, the shorter the light-emitting control signal EM is at the high level, the longer the light-emitting time is, and the brighter the average brightness is. The light-emitting control signal is indicated by EM, in greater detail, indicated by EM1, EM2 . . . EMn as shown in FIG. 8.

The signal output terminal OUT of the shift register circuit 410 and a light-emitting control terminal of the pixel compensation circuit 420 are connected. The light-emitting control terminal changes a turn-on time of the light-emitting module of the pixel compensation circuit 420 correspondingly based on a pulse width variation of the time adjustment signal in the received first control signal $S_1$, thus adjusting a light-emitting time of a light-emitting component in the GOA unit correspondingly. The pulse width variation of the time adjustment signal refers to a duration variation of the time adjustment signal. The longer the time adjustment signal is, the longer the light-emitting control signal is at the high level. Similarly, the shorter the time adjustment signal is, the shorter the light-emitting control signal is at the high level. According to this principle, the turn-on time of the light-emitting module of the pixel compensation circuit 420 can be correspondingly changed, and the light-emitting time of the light-emitting component in the corresponding GOA unit can be adjusted. The longer the light-emitting control signal is at the high level, the shorter the turn-on time of the light-emitting module is, so that the shorter the light-emitting time of the light-emitting component in the corresponding GOA unit is, and the darker the brightness is. The shorter the light-emitting control signal is at the high level, the longer the turn-on time of the light-emitting module is, so that the longer the light-emitting time of the light-emitting component in the corresponding GOA unit is, and the brighter the brightness is.

A description of the pixel compensation circuit 420 is further provided. The pixel compensation circuit 420 comprises: a first reset module 421, a second reset module 422, a compensation module 423, a write module 424, and a light-emitting module 425.

A control terminal of the first reset module 421 receives a second control signal $S_2$. Another two terminals of the first reset module 421 are respectively connected to a first reset voltage terminal and the compensation module 423. The first reset voltage terminal has a first reset voltage VI, and the first reset module 421 transmits the first reset voltage VI to the compensation module 423 under a control of the second control signal $S_2$. In the present embodiment, the first reset module 421 comprises a fourth TFT T4. A gate of the fourth TFT T4 receives the second control signal $S_2$. A source receives the first reset voltage VI. A drain is connected to the compensation module 423. The fourth TFT T4 transmits the first reset voltage VI to the compensation module 423 under the control of the second control signal $S_2$. The second control signal $S_2$ is a scan[n−1] scan signal. The first reset voltage is VI.

A control terminal of the second reset module 422 receives a third control signal $S_3$. Another two terminals of the second reset module 422 are respectively connected to a second reset voltage terminal and the light-emitting module 425. The second reset voltage terminal has a second reset voltage, and the second reset module 422 transmits the second reset voltage to the light-emitting module 425 under a control of the third control signal $S_3$. In the present embodiment, the second reset module 422 comprises a seventh TFT T7. A gate of the seventh TFT T7 receives the third control signal $S_3$. A source receives the second reset voltage. A drain is connected to the light-emitting module 425. The seventh TFT T7 transmits the second reset voltage to the light-emitting module 425 under the control of the third control signal $S_3$. The third control signal $S_3$ is a scan[n] signal. The second reset voltage is VI. In the present embodiment, the second reset voltage is the same as the first reset voltage. Of course, in some other embodiments, the second reset voltage may be different from the first reset voltage.

A control terminal of the write module 424 receives a fourth control signal $S_4$. An input terminal of the write module 424 is connected to a data signal terminal and receives a data signal from the data signal terminal. An output terminal of the write module 424 is connected to the compensation module 423. The write module 424 transmits the data signal to the compensation module 423 under a control of the fourth control signal $S_4$. In the present embodiment, the write module 424 comprises a third TFT T3. A gate of the third TFT T3 receives the fourth control signal $S_4$. A source is connected to the data signal terminal. A drain is connected to the compensation module 423. The third TFT T3 transmits the data signal of the data signal terminal to the compensation module 423 under the control of the fourth control signal $S_4$. The fourth control signal $S_4$ is the scan[n] signal.

The compensation module 423 receives a fifth control signal $S_5$ and is connected to the first reset module 421, the write module 424 and the light-emitting module 425. The compensation module 423 performs threshold voltage compensation under a control of the fifth control signal $S_5$. The fifth control signal $S_5$ is the scan[n] signal. In the present embodiment, the compensation module 423 comprises a first TFT T1, a second TFT T2, and a storage capacitor Cst. A gate of the first TFT T1 is connected to the drain of the fourth TFT T4 of the first reset module 421, one terminal of the storage capacitor Cst, and a drain of the second TFT T2. A source is connected to a source of a sixth TFT T6 of the light-emitting module 425 and the drain of the third TFT T3 of the write module 424. A drain is connected to a drain of a fifth TFT T5 of the light-emitting module 425 and a source of the second TFT T2. A gate of the second TFT T2 receives the fifth control signal $S_5$. Another terminal of the storage capacitor Cst is connected to a first voltage terminal.

One terminal of the light-emitting module 425 is connected to a second voltage terminal and receives a second voltage VSS from the second voltage terminal. Another two terminals of the light-emitting module 425 are both connected to the compensation module 423. A light-emitting control terminal of the light-emitting module 425 and the signal output terminal OUT of the shift register circuit 410 are connected. The light-emitting module 425 changes the turn-on time correspondingly based on the pulse width variation of the time adjustment signal in the received first control signal $S_1$ so as to adjust the light-emitting time of the light-emitting component in the corresponding GOA unit. In the present embodiment, the light-emitting module 425 comprises the fifth TFT T5, the sixth TFT T6, and a light-emitting component OLED. A gate of the sixth TFT T6 is connected to the light-emitting control terminal. A drain receives a first voltage VDD from the first voltage terminal. The source is connected to the source of the first TFT T1 of the compensation module 423. A gate of the fifth TFT T5 is connected to the light-emitting control terminal. The drain is connected to the drain of the first TFT T1 of the compensation module 423. A source is connected to an anode of the light-emitting component OLED and the drain of the seventh TFT T7 of the second reset module 422. A cathode of the light-emitting component OLED is connected to the second voltage terminal. The first voltage is the power supply voltage VDD.

In the present embodiment, the TFTs T1, T2, T3, T4, T5, T6 and T7 are all P-type TFTs. Therefore, when the control signals of these TFTs are set to the low level, the corresponding TFTs are turned on. Of course, in practical circuit design, the TFTs used in the embodiment of the present disclosure may adopt N-type TFTs or a mixture of N-type TFT(s) and P-type TFT(s). In addition, functions of the source and the drain of each of the TFTs used may be interchanged depending on the various types and control signals of the TFT, and a detailed description is not provided herein.

Additionally, the first reset voltage, the second reset voltage and the second voltage are low voltages, and the first voltage is a high voltage. The first voltage refers to the power supply voltage VDD, and the second voltage refers to the common ground voltage VSS.

A description is provided with reference to FIG. 8. FIG. 8 is a schematic diagram of a display device according to one embodiment of the present disclosure. The display device is an AMOLED display device. The display device comprises a plurality of GOA units 811 (that is, pixel units) disposed in a display panel 810. The plurality of GOA units 811 are arranged in an array. Each of the GOA units 811 comprises the above pixel drive circuit and the corresponding light-emitting component. The pixel drive circuit of each of the GOA units 811 is connected to a power supply trace 814 for providing a power supply voltage VDD. The display device further comprises a data driver 812 for providing data signals and a scan driver 813 for providing scan signals and control signals. Each of the GOA units 811 is connected to the scan driver 813 through a scan line and connected to the data driver 812 through a data line. The scan driver 813 generates the scan signals (such as $S_1$, $S_2$, $S_3$ . . . in FIG. 8) and the control signals (such as EM1, EM2, EM3 . . . in FIG. 8, including the first control signal $S_1$ as described above), which are sequentially provided to the GOA units 811 respectively through scan lines and control lines. The data driver 812 generates the data signals corresponding to image data externally provided, and provides the data signals to the GOA units 811 through data lines.

The lighting of the display device requires two power supply voltages, VDD and VSS, which can be supplied by a power chip (not shown in the figure) (Power IC). When the display device is lit to work, the GOA unit 811 near the power input side and the GOA unit 811 away from the power input side are applied with the same power supply voltage VDD. However, due to an impedance of the power supply trace, the actual power supply voltage VDD reaching each row of GOA units is different. A power supply voltage Vdd1 of a power supply position close to the power supply voltage is higher than a power supply voltage Vdd2 of a power supply position away from the power supply voltage. This phenomenon is called resistance drop. For example, when the power chip is located at a lower end of the display device, the display device in the related art tends to have a dark upper end and a bright lower end because the lower end of the display device is relatively close to the power supply voltage VDD and the upper end of the display device is relatively far away from the power supply voltage VDD.

In order to resolve the problem that the upper end is dark and the lower end is bright in the display device in the related art, the present disclosure performs pulse with modulation on the time adjustment signal in the first control signal $S_1$ generated by the shift register circuit 410 within the predetermined time period through adjusting the voltage adjustment module 411. The light-emitting control terminal in the pixel compensation circuit 420 changes the turn-on time of the light-emitting module 425 of the pixel compensation circuit 420 correspondingly based on the pulse width variation of the time adjustment signal in the received first control signal $S_1$, thus adjusting the light-emitting time of the light-emitting component in the corresponding GOA unit. In other words, the longer the time adjustment signal is, the longer the light-emitting control signal is at the high level. The shorter the time adjustment signal is, the shorter the light-emitting control signal is at the high level. In this manner, the turn-on time of the light-emitting module 425 of the pixel compensation circuit 420 can be changed correspondingly, and the light-emitting time of the light-emitting component in the corresponding GOA unit 811 is adjusted. The longer the light-emitting control signal is at the high level, the shorter the turn-on time of the light-emitting module 425 is, so that the shorter the light-emitting time of the light-emitting component in the corresponding GOA unit 811 is, and the darker the brightness is. The shorter the light-emitting control signal is at the high level, the longer the turn-on time of the light-emitting module 425 is, so that the longer the light-emitting time of the light-emitting component in the corresponding GOA unit 811 is, and the brighter the brightness is.

As mentioned previously, the time adjustment signal according to the present disclosure is a pulse signal, and its right edge is aligned with the left edge of the blanking area. The low level of the enable signal S is in the blanking area, and its falling edge is aligned with the left edge of the blanking area. In the blanking area, the enable signal S is in the enabled state to forcibly set the time adjustment signal to the low level, and thus the high-level pulse of the inserted time adjustment signal is gradually narrowed. As a result, the brightness of the lower end of the display panel of the display device can be suppressed, and the influence of the resistance drop that causes the lower end of the display panel has higher brightness than the upper end is cancelled, thereby improving the uniformity of the display panel.

Figure 9:
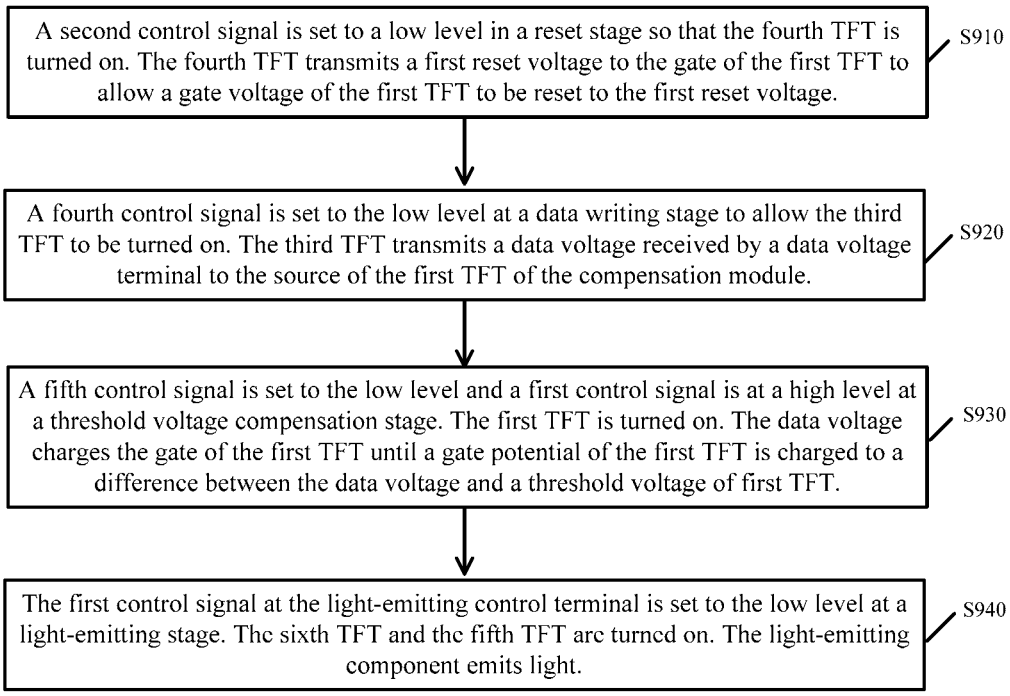
FIG. 9 is a flowchart of steps of a driving method adopting a pixel drive circuit according to one embodiment of the present disclosure.

A description is provided with reference to FIG. 9. FIG. 9 is a flowchart of steps of a driving method of a pixel drive circuit. The present disclosure further provides a driving method adopting the above pixel drive circuit. Since a detailed structure of the pixel drive circuit is described above, a description in this regard is not provided.

The driving method comprises the following steps:

Step S910: A second control signal is set to a low level in a reset stage so that the fourth TFT is turned on. The fourth TFT transmits a first reset voltage to the gate of the first TFT to allow a gate voltage of the first TFT to be reset to the first reset voltage.

In the present embodiment, the fourth TFT is a P-type TFT so it is turned on at the low level.

Step S920: A fourth control signal is set to the low level at a data writing stage to allow the third TFT to be turned on. The third TFT transmits a data voltage received by a data voltage terminal to the source of the first TFT of the compensation module 423.

In the present embodiment, the third TFT is a P-type TFT so it is turned on at the low level.

Step S930: A fifth control signal is set to the low level and a first control signal is at a high level at a threshold voltage compensation stage. The first TFT is turned on. The data voltage charges the gate of the first TFT until a gate potential of the first TFT is charged to a difference between the data voltage and a threshold voltage of first TFT.

In the present embodiment, the first TFT is a P-type TFT so it is turned on at the low level.

In step S930, a third control signal is set to the low level. The seventh TFT is turned on to transmit a second reset voltage to the light-emitting module 425. The seventh TFT is a P-type TFT Step S940: The first control signal at the light-emitting control terminal is set to the low level at a light-emitting stage. The sixth TFT and the fifth TFT are turned on. The light-emitting component emits light. Step S940 further comprises: performing pulse width modulation on a time adjustment signal in the first control signal generated by the shift register circuit 410 through the voltage adjustment module 411 within a predetermined time period, so that a light-emitting time of the pixel compensation circuit 420 varies with the pulse width modulation. The predetermined time period is a time period between an end of writing all data signals of one frame and a start of a control signal of a next frame.

The fifth TFT and the sixth TFT are P-type TFTs.

The present disclosure is described in detail in accordance with the above contents with the specific preferred examples. However, this present disclosure is not limited to the specific examples. For the ordinary technical personnel of the technical field of the present disclosure, on the premise of keeping the conception of the present disclosure, the technical personnel can also make simple deductions or replacements, and all of which should be considered to belong to the protection scope of the present disclosure.

Industrial Applicability

The subject-matter of the present disclosure is industrially applicable, complying industrial applicability.

What is claimed is:

1. A pixel drive circuit corresponding to a GOA unit, wherein the pixel drive circuit comprises: a shift register circuit and a pixel compensation circuit;

the shift register circuit comprising a signal input terminal, a signal output terminal and at least one clock signal input terminal, the signal input terminal being configured to receive an input signal, the clock signal input terminal being configured to receive a clock signal, the shift register circuit being configured to process the input signal based on the clock signal and generate a first control signal and transmit the first control signal to the signal output terminal, wherein the first control signal comprises a voltage compensation signal for compensating for a threshold voltage of the pixel compensation circuit and a time adjustment signal for adjusting a light-emitting time of the pixel compensation circuit;

the shift register circuit further comprising a voltage adjustment module, the voltage adjustment module being connected to the signal output terminal of the shift register circuit, the voltage adjustment module being configured to perform pulse width modulation on the time adjustment signal in the first control signal generated by the shift register circuit within a predetermined time period, so that the light-emitting time of the pixel compensation circuit varies with the pulse width modulation, wherein the predetermined time period is a time period between an end of writing all data signals of one frame and a start of a control signal of a next frame;

the signal output terminal of the shift register circuit being connected to a light-emitting control terminal of the pixel compensation circuit, the light-emitting control terminal changing a turn-on time of a light-emitting module of the pixel compensation circuit correspondingly based on a pulse width variation of the time adjustment signal in the received first control signal so as to adjust a light-emitting time of a light-emitting component in the corresponding GOA unit, wherein the voltage adjustment module comprises a voltage adjustment control terminal, a voltage adjustment input terminal, and a voltage adjustment output terminal, the voltage adjustment input terminal is configured to receive a threshold value voltage signal, the voltage adjustment output terminal is connected to the signal output terminal of the shift register circuit, the voltage adjustment control terminal is configured to receive an enable signal within the predetermined time period, and perform pulse width modulation on the time adjustment signal through the threshold value voltage signal under a control of the enable signal.

2. The pixel drive circuit as claimed in claim 1, wherein the pixel compensation circuit comprises a first reset module, a second reset module, a compensation module, a write module, and a light-emitting module;

a control terminal of the first reset module receiving a second control signal, another two terminals of the first reset module being respectively connected to a first reset voltage terminal and the compensation module, the first reset voltage terminal having a first reset voltage, and the first reset module transmitting the first reset voltage to the compensation module under a control of the second control signal;

a control terminal of the second reset module receiving a third control signal, another two terminals of the second reset module being respectively connected to a second reset voltage terminal and the light-emitting module, the second reset voltage terminal having a second reset voltage, and the second reset module transmitting the second reset voltage to the light-emitting module under a control of the third control signal;

a control terminal of the write module receiving a fourth control signal, an input terminal of the write module being connected to a data signal terminal and receiving a data signal from the data signal terminal, an output terminal of the write module being connected to the compensation module, the write module transmitting the data signal to the compensation module under a control of the fourth control signal;

the compensation module receiving a fifth control signal, and being connected to the first reset module, the write module and the light-emitting module, the compensation module performing threshold voltage compensation under a control of the fifth control signal;

one terminal of the light-emitting module being connected to a second voltage terminal and receiving a second voltage from the second voltage terminal, another two terminals of the light-emitting module being both connected to the compensation module, the light-emitting control terminal of the light-emitting module and the signal output terminal of the shift register circuit being connected, the light-emitting module changing the turn-on time correspondingly based on the pulse width variation of the time adjustment signal in the received first control signal so as to adjust the light-emitting time of the light-emitting component in the corresponding GOA unit.

3. The pixel drive circuit as claimed in claim 2, wherein the first reset module comprises a fourth TFT, a gate of the fourth TFT receives the second control signal, a source receives the first reset voltage, a drain is connected to the compensation module, the fourth TFT transmits the first reset voltage to the compensation module under the control of the second control signal.

4. The pixel drive circuit as claimed in claim 3, wherein the second reset module comprises a seventh TFT, a gate of the seventh TFT receives the third control signal, a source receives the second reset voltage, a drain is connected to the light-emitting module, the seventh TFT transmits the second reset voltage to the light-emitting module under the control of the third control signal.

5. The pixel drive circuit as claimed in claim 4, wherein the write module comprises a third TFT, a gate of the third TFT receives the fourth control signal, a source is connected to the data signal terminal, a drain is connected to the compensation module, the third TFT transmits the data signal of the data signal terminal to the compensation module under the control of the fourth control signal.

6. The pixel drive circuit as claimed in claim 5, wherein the compensation module comprises a first TFT, a second TFT, and a storage capacitor, the gate of the first TFT is connected to the drain of the fourth TFT of the first reset module, one terminal of the storage capacitor and a drain of the second TFT, a source is connected to a source of a sixth TFT of the light-emitting module and the drain of the third TFT of the write module, a drain is connected to a drain of a fifth TFT of the light-emitting module and a source of the second TFT, a gate of the second TFT receives the fifth control signal, another terminal of the storage capacitor is connected to a first voltage terminal.

7. The pixel drive circuit as claimed in claim 6, wherein a gate of the sixth TFT is connected to the light-emitting control terminal, a drain receives a first voltage from the first voltage terminal, the source is connected to the source of the first TFT of the compensation module, a gate of the fifth TFT is connected to the light-emitting control terminal, the drain is connected to the drain of the first TFT of the compensation module, a source is connected to an anode of the light-emitting component and the drain of the seventh TFT of the second reset module, a cathode of the light-emitting component is connected to the second voltage terminal.

8. The pixel drive circuit as claimed in claim 2, wherein the first reset voltage, the second reset voltage, and the second voltage are low voltages, the first voltage is a high voltage.

9. The pixel drive circuit as claimed in claim 2, wherein the first TFT, second TFT, third TFT, fourth TFT, fifth TFT, sixth TFT, and seventh TFT are P-type TFTs.

10. A display device comprising a plurality of gate on array (GOA) units, wherein each of the GOA units comprises a light-emitting component and a pixel drive circuit as claimed in claim 1, and each of the GOA units connects to a power supply trace that supplies power supply voltage.

11. A method of driving the pixel driving circuit as claimed in claim 7, comprising:

(a) at a reset stage, setting a second control signal to a low level so that the fourth TFT is turned on, wherein the fourth TFT transmits a first reset voltage to the gate of the first TFT to allow a gate voltage of the first TFT to be reset to the first reset voltage;

(b) at a data writing stage, setting a fourth control signal to the low level to allow the third TFT to be turned on, wherein the third TFT transmits a data voltage received by a data voltage terminal to the source of the first TFT of the compensation module;

(c) at a threshold voltage compensation stage, setting a fifth control signal to the low level and a first control signal to the high level, so that the first TFT is turned on, wherein the data voltage charges the gate of the first TFT until a gate potential of the first TFT is charged to a difference between the data voltage and a threshold voltage of first TFT; and (d) at a light-emitting stage, setting the first control signal at the light-emitting control terminal to the low level, so that the sixth TFT and the fifth TFT are turned on, and the light-emitting component emits light, wherein the step (d) further comprises: performing pulse width modulation on a time adjustment signal in the first control signal generated by a shift register circuit through a voltage adjustment module within a predetermined time period, so that a light-emitting time of the pixel compensation circuit varies with the pulse width modulation, wherein the predetermined time period is a time period between an end of writing all data signals of one frame and a start of a control signal of a next frame.

12. The method as claimed in claim 11, wherein the step (c) comprises: setting a third control signal set to the low level so that the seventh TFT is turned on to transmit a second reset voltage to the light-emitting module.

* * * * *